US005678253A

United States Patent [19]

Baker

[11] Patent Number: 5,678,253

[45] Date of Patent: Oct. 21, 1997

[54] ADJUSTABLE POOL FLOORING STRUCTURE

[76] Inventor: William H. Baker, 50 Fairway Ridge, Lake Wylie, S.C. 29710

[21] Appl. No.: 672,589

[22] Filed: Jun. 28, 1996

[51] Int. Cl.[6] ..... E04H 4/00

[52] U.S. Cl. ..... 4/495; 4/504; 254/89 R

[58] Field of Search ..... 4/495, 564.1, 565.1, 4/566.1, 504; 254/8 C, 89 R

[56] References Cited

U.S. PATENT DOCUMENTS

| | | | |
|---|---|---|---|
| 3,220,585 | 11/1965 | McCartney | 254/8 C |
| 3,287,024 | 11/1966 | Ulinski | 254/8 C |
| 3,670,343 | 6/1972 | Gansloser . | |
| 4,229,843 | 10/1980 | Belanger . | |
| 4,574,404 | 3/1986 | Stark, Sr. . | |
| 4,937,896 | 7/1990 | Niimura . | |
| 5,025,512 | 6/1991 | Niimura . | |
| 5,295,929 | 3/1994 | Weisz | 4/495 |

*Primary Examiner*—David J. Walczak
*Attorney, Agent, or Firm*—Shefte, Pinckney & Sawyer

[57] ABSTRACT

An adjustable flooring structure for a pool includes a platform and three groups of hydraulic cylinders. The first group of cylinders is vertically mounted to the platform and is extendable between a minimum first length and a maximum first length for lifting the pool from a minimum height to an intermediate height. The second group of cylinders is pivotally mounted to the platform and movable between a horizontal disposition and a vertical disposition for lifting of the platform. The second group of cylinders is extendable between a minimum second length and a maximum second length for lifting the platform from the intermediate height to the maximum height when the second group of cylinders are vertically disposed. The third group of cylinders are pivotally mounted to the platform and are pivotally mounted to the second group of cylinders for moving the second group of cylinders between the horizontal disposition and the vertical disposition when the platform is at the intermediate height. Alternatively, the second and the third groups of cylinders can be mounted to the base of the pool rather than the platform. Hydraulic lines connect the cylinders to a hydraulic power pack and a control panel for controlling the operation of the three groups of cylinders. Wheels are mounted to the edges of the platform and disposed in channels along the side walls of the pool to position and guide the platform within the pool.

20 Claims, 6 Drawing Sheets

ADJUSTABLE POOL FLOORING STRUCTURE

BACKGROUND OF THE INVENTION

The present invention relates to adjustable flooring structures for use in swimming pools, and particularly to flooring structures which are supported and lifted by hydraulic cylinders and the like which are disposed above the base of the swimming pool.

Since the construction costs of swimming pools, and in particular large swimming pools of Olympic dimensions, is great and requires substantial capital investment, most municipalities and universities strive for better general use of such facilities. The Olympic pools used for international swimming competition are required to have a depth of approximately seven feet, and because of this depth, such pools are of limited use for general public swimming, and in particular are unsuitable for use by young children. For this reason, various adjustable pool floors have been proposed so that the depth &water can be varied between a level suitable for general public use and a level suitable for competition swimming.

However, such adjustable floors as have hitherto been proposed are generally very expensive to install and maintain and usually require considerable modification of the structure of the pools in which they are installed. Furthermore, because of their complexity, such adjustable floor structures typically must be installed at the time of the construction of the pool, as installation afterwards is usually cost prohibitive. For instance, in Gransloser, U.S. Pat. No. 3,670,343, hydraulic cylinders are fixed in place underneath the swimming pool and would require substantial construction to install in an existing pool. On the other hand, when the flooring structures are not installed beneath the swimming pool, the flooring structures generally consume substantial space so that even when the adjustable floor is lowered to the lowest level, the depth of the pool is insufficient for certain uses.

There thus exists a demand in the pool construction industry for an adjustable flooring structure that can be installed in an existing swimming pool and that requires little modification of the existing pool structure, but that consumes a relatively small volume and small height at the bottom of the pool so that the original depth of the pool is not significantly reduced.

BRIEF SUMMARY OF THE INVENTION

Briefly summarized, the flooring structure of the present invention comprises a platform and two groups of lifting cylinders disposed above the base of the swimming pool for lifting of the platform. Preferably hydraulic cylinders are used, but pneumatic cylinders or any similar lifting devices can be used. The first group of cylinders are extendable between a minimum first length and a maximum first length and the second group of cylinders are extendable between a minimum second length and a maximum second length. Furthermore, the first group of cylinders are vertically mounted to the platform and lift the platform from its minimum height to an intermediate height above the swimming pool base when the first group of cylinders extends from the minimum first length to the maximum first length. The second group of cylinders may be mounted either to the the platform or to the base of the swimming pool and lift the platform from its intermediate height to its maximum height above the base when the second group of cylinders extends from the minimum second length to the maximum second length.

A feature of the present invention includes the pivotable mounting of the second group of cylinders for rotation between a horizontal disposition and a vertical disposition for lifting of the platform, and includes the first maximum length of the first group of cylinders being greater than the second minimum length of the second group of cylinders.

A further feature of the present invention includes a third group of cylinders disposed above the base of the swimming pool and connected to the second group of cylinders. The third group of cylinders serves to move the second group of cylinders into a disposition for lifting the platform when the platform is at the intermediate height. Moreover, the third group of cylinders is preferably mounted to the same structure as the second group of cylinders, i.e., either to the platform or to the base of the pool.

Another feature of the present invention includes a control system for controlling the respective extensions of the first and second groups of cylinders, and for use in further controlling the extension of the third group of cylinders. The control system therefore can be used to selectively adjust the depth of the pool, i.e., adjust the height of the platform between the minimum height and the maximum height above the base.

Yet another feature of the present invention includes guides attached to the platform for positioning of the platform against the wails of the swimming pool. Preferably, the guides include wheels mounted to the platform and disposed in channels in the pool walls.

DETAILED DESCRIPTION OF THE PREFERRED EMBODIMENTS

Referring now to FIGS. 1–6, and initially FIGS. 1–4, one embodiment of the flooring structure 10 of the present invention is shown disposed in a swimming pool.

The flooring structure 10 comprises a platform 12 and three groups of hydraulic cylinders. The platform 12 is conventional and preferably includes a stainless steel flame having a top surface 13 fibbed for water flow through channels formed by the ribs (not shown). Furthermore, the platform 12 is preferably dimensioned to fit the horizontal cross-sectional area of the swimming pool with an approximate ⅜-inch gap maintained between the edges of the platform 12 and the walls of the pool. The platform 12 may also include conventional buoyancy chambers and the like to regulate buoyancy (not shown).

Figure 4:
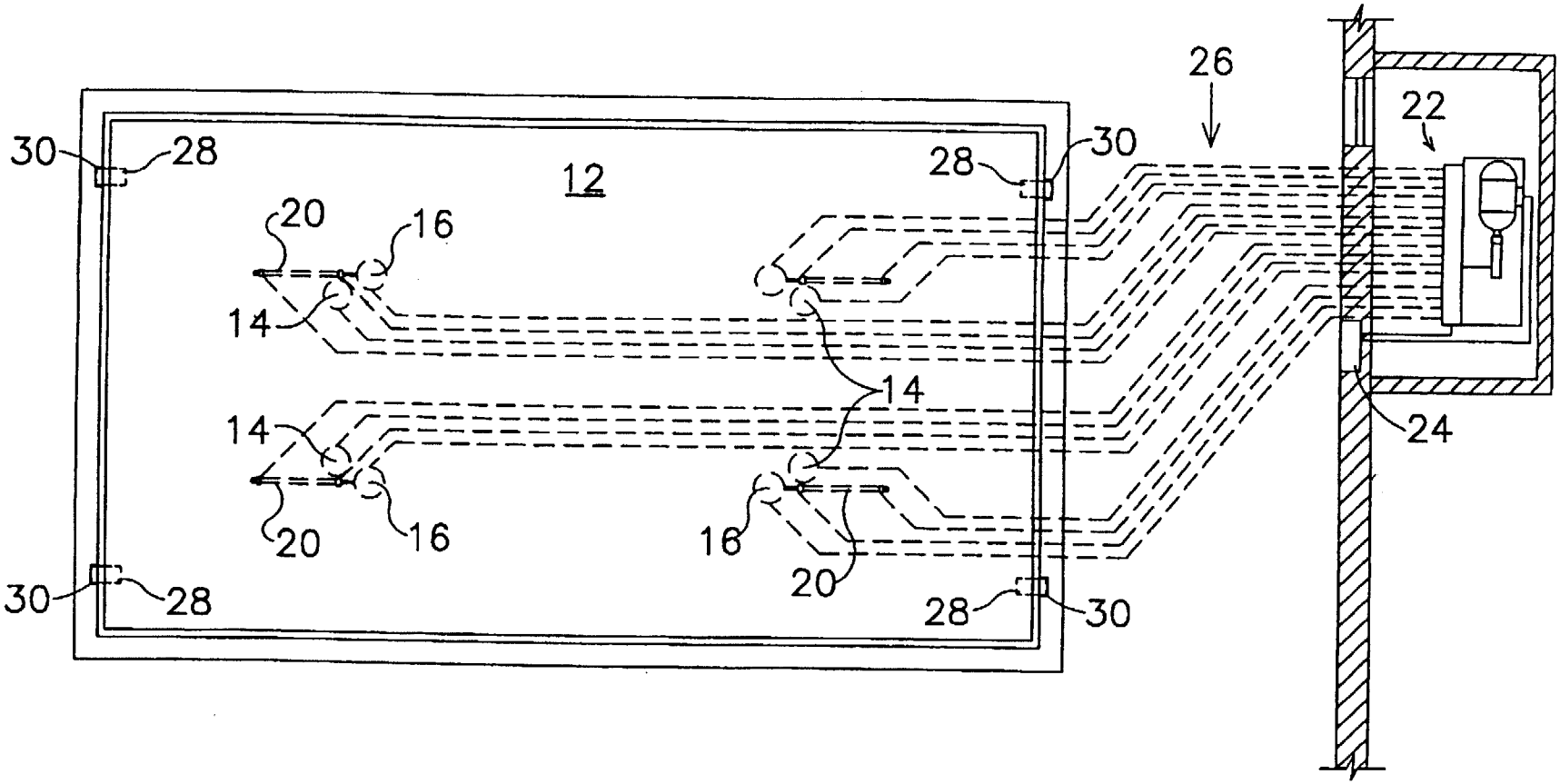
FIG. 4 is a top plan view of the flooring structure illustrated in FIG. 1.

With regard to the lifting cylinders, the lifting cylinders 14 of the first group are mounted to the platform 12 in vertical, lifting disposition. The lifting cylinders 14 preferably are mounted to the underneath of the platform 12, and each of the cylinders 14 has a length when contracted of between 2½ and 3 feet and has a length when fully extended of between 4½ and 5 feet. Furthermore, while any stable array of the cylinders 14 may be used, there are preferably four cylinders 14 positioned in a rectangular formation as shown in FIG. 4.

Figure 1:
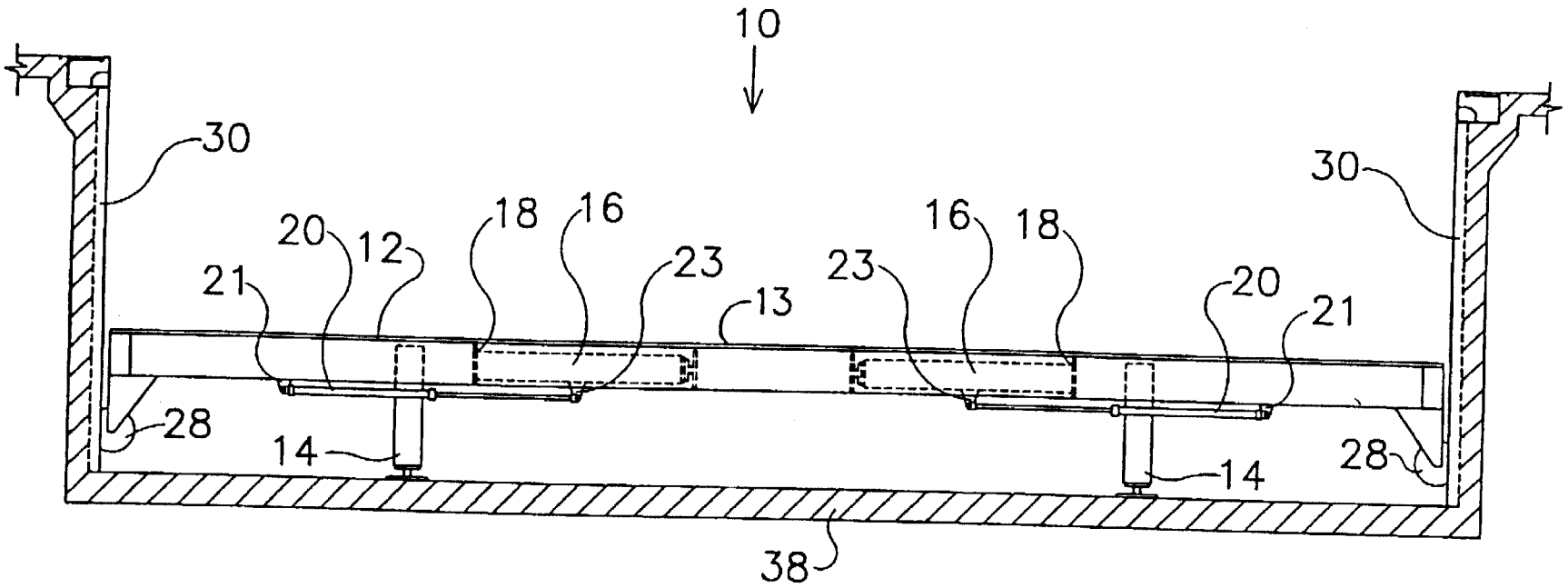
FIG. 1 is a side view of a flooring structure of the present invention illustrated with the platform at its minimum height.
Figure 2:
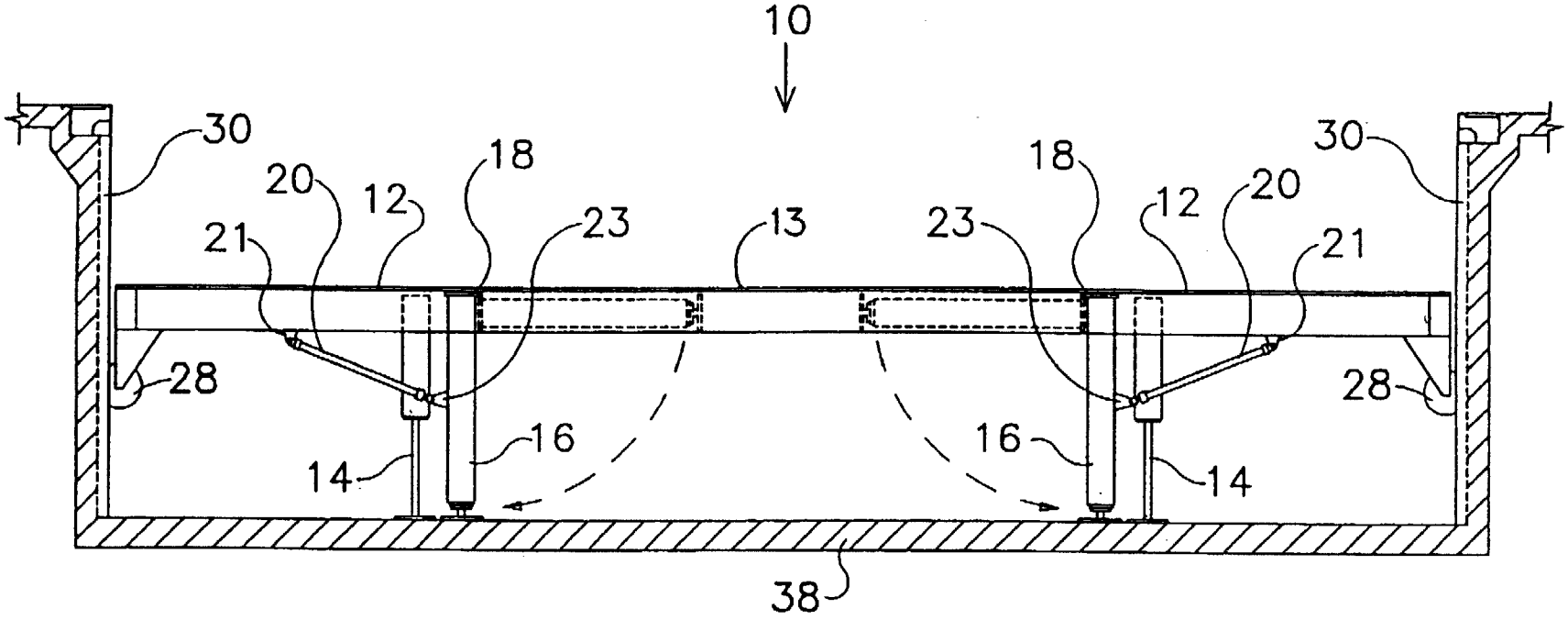
FIG. 2 is a side view of the flooring structure of FIG. 1 illustrated with the platform at its intermediate height.
Figure 3:
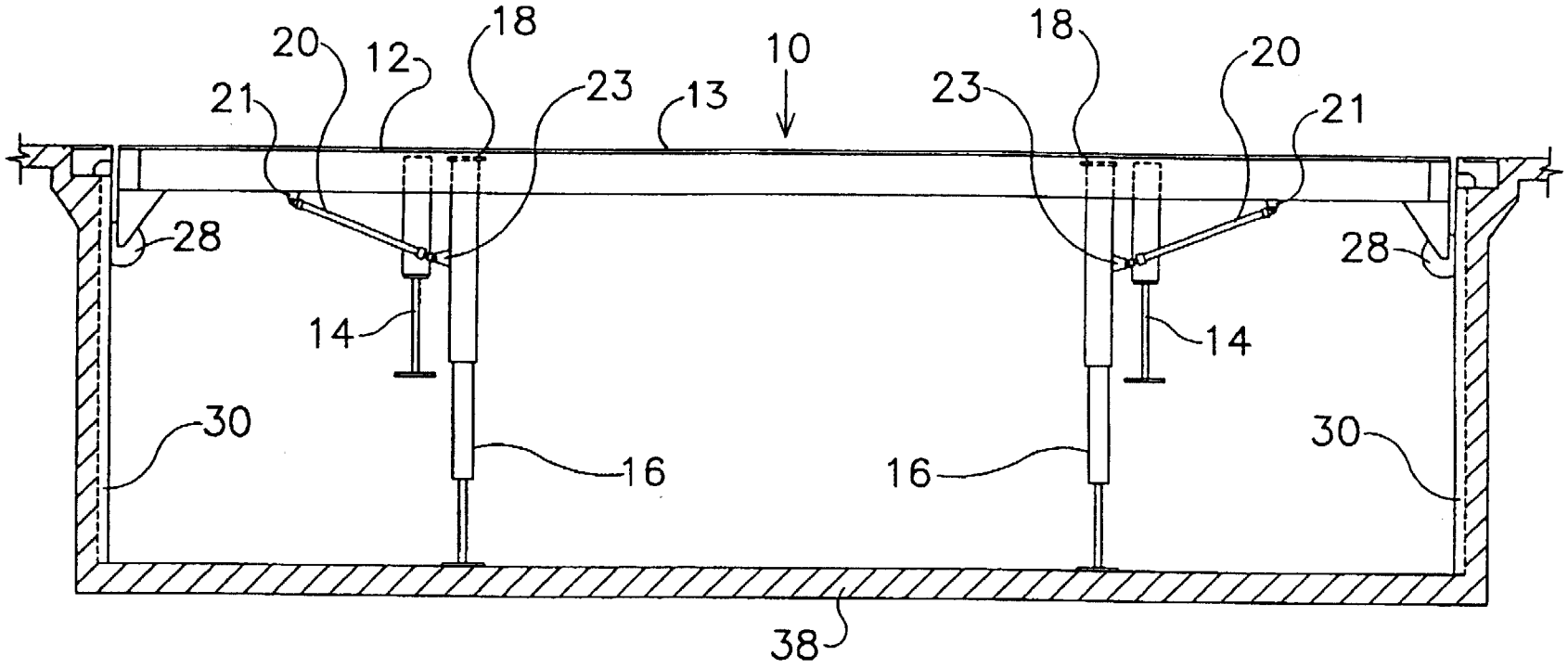
FIG. 3 is a side view of the flooring structure of FIG. 1 illustrated with the platform at its maximum height.

The lifting cylinders 16 of the second group are also mounted to the platform 12, and preferably pivotally mounted to the underneath of the platform 12 by hinges 18 and are pivotable between a horizontal disposition (shown in FIG. 1) and a vertical disposition for lifting of the platform 12 (shown in FIGS. 2–3). Each of the cylinders 16 has a length when contracted of between 4½ and 5 feet and has a length when fully extended of between 9½ and 10 feet. Furthermore, there are preferably four cylinders 16 in the second group, with each mounted adjacent a cylinder 14 of the first group as illustrated in FIG. 4.

The cylinders 20 of the third group are also mounted to the platform 12 by pivot mounting 21 and pivotally mounted to the cylinders 16 of the second group by pivot mounting 23, and function to move the cylinders 16 of the second group between their aforesaid horizontal dispositions and vertical dispositions. Alternatively, other positioning means can be employed, such as a pulley system or a cam arrangement and the like (not shown). The only requirement of the positioning means is that it ensures after the platform 12 is lifted to the intermediate height that the second group of cylinders 16 are moved to their vertical disposition from their horizontal disposition, and that it ensures after the platform 12 is lowered to the intermediate height that the second group of cylinders 16 are moved to their horizontal disposition from their vertical disposition, as will be described in greater detail presently. Furthermore, if desired, conventional sensors (not shown) can be mounted adjacent the cylinders 16 of the second group to detect when the vertical disposition of the cylinders 16 is obtained in order to stop the contraction of the cylinders 20 of the third group.

Each of the groups of cylinders 14,16,20 are controlled by way of a conventional hydraulic power pack 22 and control panel 24 connected to the cylinders 14,16,20 by conventional hydraulic lines 26. For clarity of illustration, the hydraulic power pack 22, the control panel 24, and the hydraulic lines 26 are shown in FIG. 4 but omitted for purposes of illustration in the other Figures.

Guides are provided at two opposing ends of the platform 12 in the form of wheels 28 for positioning of the platform 12 within the swimming pool. Preferably, four wheels 28 are provided, each adjacent a comer of the platform 12. Furthermore, the wheels 28 preferably move in corresponding channels 30 installed in the walls of the pool.

In operation, control panel 24 is utilized to operate the hydraulic power pack 22 to cause the first group of cylinders 14 to lift the platform 12 above the base of the pool from the minimum height (shown in FIG. 1) to the intermediate height (shown in FIG. 2). Now referring to FIG. 2, the third group of cylinders 20 are then caused to contract to move the second group of cylinders 16 from the horizontal disposition (shown in dotted lines) to the vertical disposition, the second group of cylinders 16 being disposed in the horizontal disposition when the platform 12 is at a height less than the intermediate height because the minimum length of the second group of cylinders 16 can exceed the spacing between the platform 12 and the base 38 of the pool. Consequently, the minimum height of the platform 12 is limited only by the contracted length of the cylinders 14 of the first group that extends below the platform 12. When the cylinders 16 of the second group have been positioned in the vertical disposition, the cylinders 16 are activated by the control panel 24 to extend and continue lifting the platform 12 to its maximum height as illustrated in FIG. 3.

Preferably, in operation, the height of the platform above the base 38 is adjustable, in that the extension of the cylinders 14,16 of the first and second groups can be stopped by way of the control panel 24 at any point inbetween the minimum height and the maximum height and sustained and supported there by one of the groups of cylinders 14,16. A conventional depth sensor (not shown) can be mounted to the platform 12 for continually monitoring and indicating on the control panel 24 the depth of the platform 12.

Figure 5:
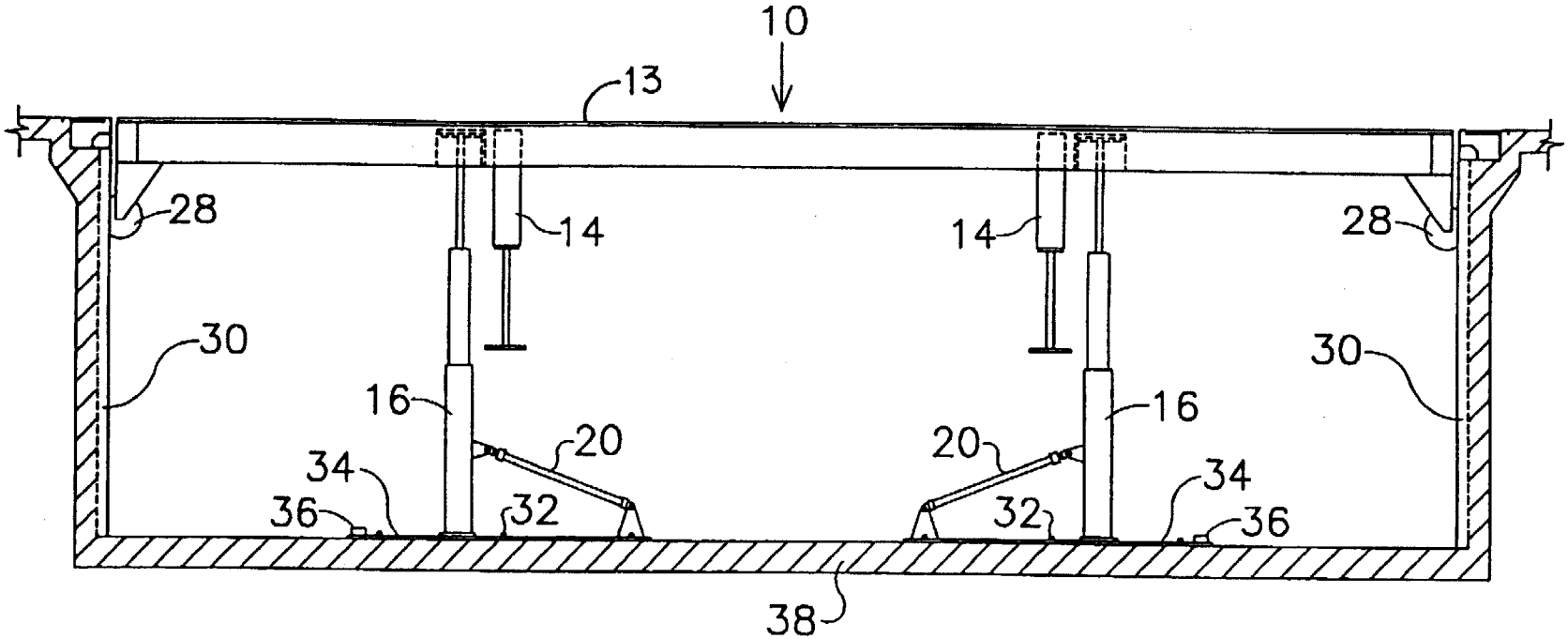
FIG. 5 is a side view of another flooring structure of the present invention.
Figure 6:
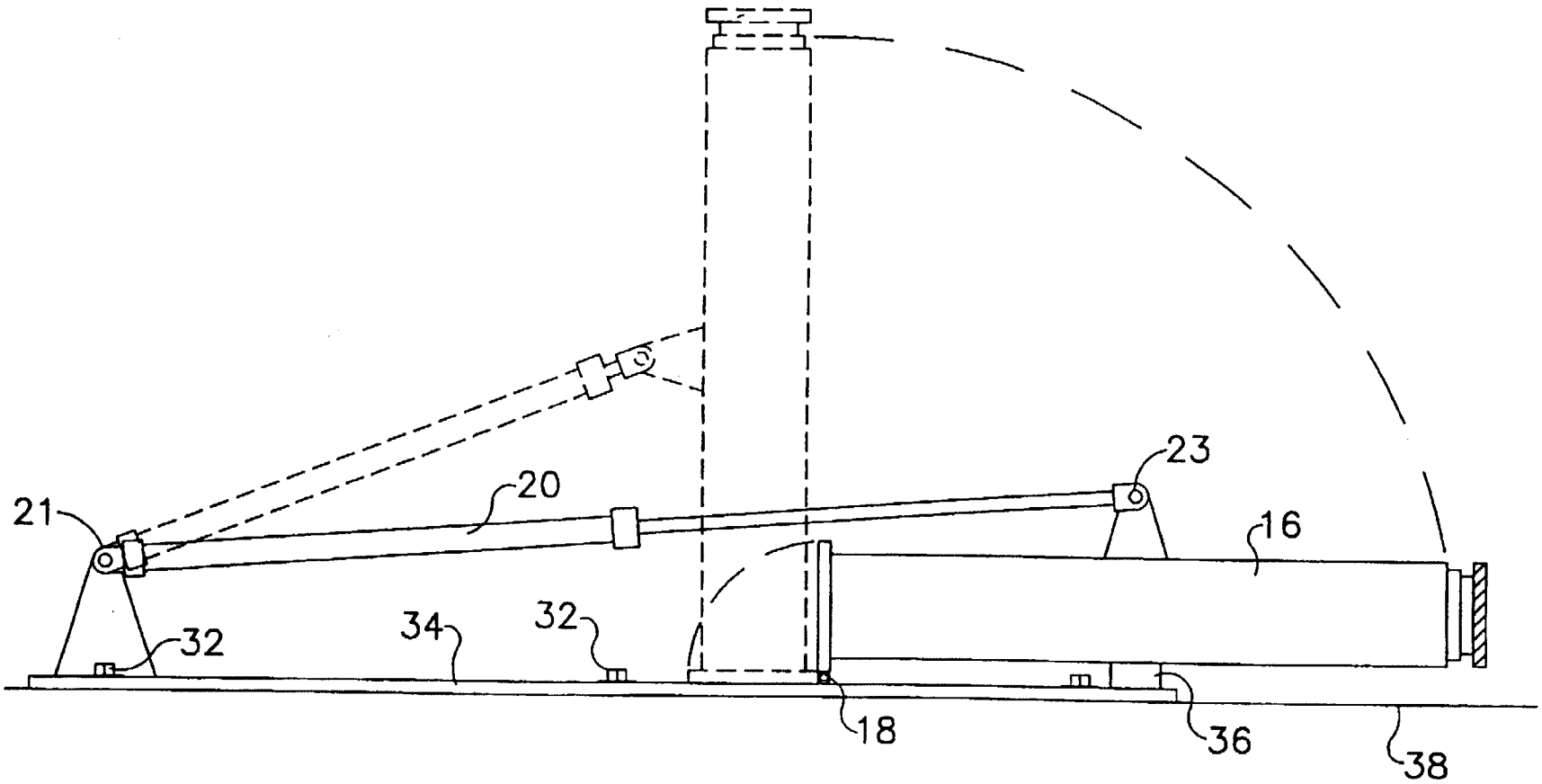
FIG. 6 is a side view of a cylinder of the second group and a corresponding cylinder of the third group of the flooring structure illustrated in FIG. 5.

The embodiment of FIGS. 5 and 6 is substantially similar to the embodiment in FIGS. 1–4 and like structures are referred to with like reference numbers. The flooring structure shown in FIGS. 5 and 6 differs from the other flooring structure of FIGS. 1–4 only in the mounting of the second and third groups of cylinders 16,20 to the base 38 of the pool rather than to the the platform 12. As shown in FIG. 6, the cylinders 16,20 of the second and third groups are mounted by bolts 32 to an anchor plate 34 which in turn is mounted to the base 38 of the pool in a conventional manner. Bumpers 36 are also provided on the anchor plate 34 of the pool for abutment with the cylinders 16 of the second group upon their returning to the horizontal disposition adjacent the pool base 38. Operation of the flooring structure of FIGS. 5 and 6 is otherwise identical to that of FIGS. 1–4.

The preferred flooring structure of the present invention thus achieves the goals of the present invention. The height consumed by the installation of the flooring structure is limited only by the height of the first group of cylinders that extends below the platform. Furthermore, the height of the first group of cylinders is limited only by the requirement that the first group of cylinders be extendable beyond the minimum length of the second, group of cylinders so that the second group of cylinders can be positioned for lifting of the platform. The flooring structure of the present invention also is easily installable in a preexisting pool with only minor modifications that must be made to the preexisting pool, and at significantly reduced expense than other adjustable floor structures.

It will therefore be readily understood by those persons skilled in the an that the present invention is susceptible of a broad utility and application. Many embodiments and adaptations of the present invention other than those herein described will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A floor for a swimming pool that is adjustable in height for varying the depth of the swimming pool, comprising:

a platform having a top surface for use as a swimming pool floor, said platform disposed above a base of the swimming pool, a first group of lifting cylinders disposed above the base and being extendable between a minimum first length and a maximum first length to lift said platform from a minimum height to an intermediate height above the base, and a second group of lifting cylinders disposed above the base and being extendable between a minimum second length and a maximum second length only in a vertical direction to lift said platform from said intermediate height to a maximum height above the base.

2. A floor according to claim 1, further comprising positioning means disposed above the base and connected to said second group of cylinders for moving said second group of cylinders to a disposition for lifting said platform when said platform is at said intermediate height.

3. A floor according to claim 2, wherein said first group of cylinders is mounted to said platform in a vertical disposition for engaging the base for said lifting of said platform.

4. A floor according to claim 3, wherein:

said second group of cylinders is pivotally mounted to said platform for movement between a horizontal disposition and a vertical disposition for engaging the base for said lifting of said platform, and said positioning means comprising a third group of cylinders connected to said second group of cylinders and to said platform for pivoting said second group from said horizontal disposition to said vertical disposition when said platform is at said intermediate height.

5. A floor according to claim 4, wherein said maximum first length of said cylinders of said first group is greater than said minimum second length of said cylinders of said second group.

6. A floor according to claim 4, further comprising control means connected to said first and said second groups of cylinders for controlling the respective extension of said first and said second groups of cylinders.

7. A floor according to claim 3, wherein:

said second group of cylinders is adapted to be pivotally mounted to the base of the swimming pool for movement between a horizontal disposition adjacent the base and a vertical disposition for engaging said platform for said lifting of said platform, and said positioning means comprising a third group of cylinders connected to said second group of cylinders and adapted to be connected to the base for pivoting said second group between said horizontal disposition and said vertical disposition when said platform is at said intermediate height.

8. A floor according to claim 7, wherein said maximum first length of said cylinders of said first group is greater than said minimum second length of said cylinders of said second group.

9. A floor according to claim 7, further comprising control means connected to said first and said second groups of cylinders for controlling the respective extension of said first and said second groups of cylinders.

10. A floor for a swimming pool that is adjustable in height for varying the depth of the swimming pool, comprising:

a platform having a top surface for use as a swimming pool floor, said platform disposed above a base of a swimming pool, a first group of lifting cylinders mounted to the underside of said platform in vertical disposition and extendable between a minimum first length and a maximum first length and all lengths therebetween, said first group of cylinders supporting and lifting said platform from a minimum height to an intermediate height above the base when said first group extends from said first minimum length to said first maximum length, a second group of lifting cylinders pivotally mounted to the underside of said platform for rotation between a horizontal disposition and a vertical disposition, and extendable between a minimum second length and a maximum second length and all lengths therebetween, said second group supporting and lifting said platform from said intermediate height to a maximum height above the base when said second group is vertically disposed and extends from said second minimum length to said second maximum length, a third group of cylinders pivotally connected to said cylinders of said second group and to said platform for moving said second group of cylinders between said horizontal and said vertical dispositions when said platform is at said intermediate height, and control means connected to said first, said second, and said third groups of cylinders for controlling the respective extension of said first, said second, and said third groups.

11. A floor for a swimming pool that is adjustable in height for varying the depth of the swimming pool, comprising:

a platform having a top surface for use as a swimming pool floor, said platform disposed above a base of the swimming pool, a first group of lifting cylinders mounted to the underside of said platform in vertical disposition and extendable between a minimum first length and a maximum first length and all lengths therebetween, said first group of cylinders supporting and lifting said platform from a minimum height to an intermediate height above the base when said first group extends from said first minimum length to said first maximum length, a second group of lifting cylinders adapted to be pivotally mounted to the base of the pool for rotation between a horizontal disposition adjacent the base of the pool and a vertical disposition, and extendable between a minimum second length and a maximum second length and all lengths therebetween, said second group supporting and lifting said platform from said intermediate height to a maximum height above the base when said second group is vertically disposed and extends from said second minimum length to said second maximum length, a third group of cylinders pivotally connected to said cylinders of said second group and adapted to be connected to the base of the pool for moving said second group of cylinders between said horizontal and said vertical dispositions when said platform is at said intermediate height, and control means connected to said first, said second, and said third groups of cylinders for controlling the respective extension of said first, said second, and said third groups of cylinders.

12. A floor for a swimming pool that is adjustable in height for varying the depth of the swimming pool, comprising:

a platform having a top surface for use as a swimming pool floor, said platform disposed above a base of the swimming pool, a first group of lifting cylinders disposed above the base and being extendable between a minimum first length and a maximum first length to lift said platform from a minimum height to an intermediate height above the base, a second group of lifting cylinders disposed above the base and being extendable between a minimum second length and a maximum second length to lift said platform from said intermediate height to a maximum height above the base, and positioning means disposed above the base and connected to said second group of cylinders for moving said second group of cylinders to a disposition for lifting said platform when said platform is at said intermediate height.

13. A swimming pool flooring structure comprising:

a base and side walls defining the swimming pool, a platform disposed within the swimming pool above said base having a top surface for use as a swimming pool floor, a first group of lifting cylinders disposed above said base and being extendable between a minimum first length and a maximum first length to lift said platform from a minimum height to an intermediate height above said base, and a second group of lifting cylinders disposed above said base and being extendable between a minimum second length and a maximum second length to lift said platform from said intermediate height to a maximum height above said base.

14. A floor according to claim 13, further comprising positioning means disposed above said base and connected to said second group of cylinders for moving said second group of cylinders to a disposition for lifting said platform when said platform is at said intermediate height.

15. A floor according to claim 14, wherein said first group of cylinders is mounted to said platform in a vertical disposition for engaging said base for said lifting of said platform.

16. A floor according to claim 15, wherein:

said second group of cylinders is pivotally mounted to said base of the swimming pool for movement between a horizontal disposition adjacent said base and a vertical disposition for engaging said platform for said lifting of said platform, and said positioning means comprising a third group of cylinders connected to said second group of cylinders and to said base for pivoting said second group between said horizontal disposition and said vertical disposition when said platform is at said intermediate height.

17. A floor according to claim 15, wherein:

said second group of cylinders is pivotally mounted to said platform for movement between a horizontal disposition and a vertical disposition for engaging said base for said lifting of said platform, and said positioning means comprising a third group of cylinders connected to said second group of cylinders and to said platform for pivoting said second group from said horizontal disposition to said vertical disposition when said platform is at said intermediate height.

18. A floor according to claim 17, further comprising control means connected to said first and said second groups of cylinders for controlling the respective extension of said first and said second groups of cylinders.

19. A floor according to claim 17, wherein said maximum first length of said cylinders of said first group is greater than said minimum second length of said cylinders of said second group.

20. A floor according to claim 19, further comprising control means connected to said first and said second groups of cylinders for controlling the respective extension of said first and said second groups of cylinders.

* * * * *